US005192202A

United States Patent [19]

Lee

[11] Patent Number: 5,192,202

[45] Date of Patent: Mar. 9, 1993

[54] SCROLL-TYPE COMPRESSOR WITH AN APPARATUS FOR RESTRAINING COMPRESSED FLUID FROM BEING LEAKED

[75] Inventor: Byung C. Lee, Seoul, Rep. of Korea

[73] Assignee: Gold Star Co., Ltd., Rep. of Korea

[21] Appl. No.: 803,116

[22] Filed: Dec. 5, 1991

[30] Foreign Application Priority Data

Dec. 8, 1990 [KR] Rep. of Korea ..... 20185/1990
Dec. 31, 1990 [KR] Rep. of Korea ..... 22011/1990

[51] Int. Cl.[5] ..... F04C 18/04
[52] U.S. Cl. ..... 418/55.5; 418/57
[58] Field of Search ..... 418/55.4, 55.5, 57, 418/107

[56] References Cited

U.S. PATENT DOCUMENTS 3,874,827 4/1975 Young ..... 418/55.5
4,300,875 11/1981 Fischer et al. ..... 418/57
4,767,293 8/1988 Caillat et al. ..... 418/55.5

FOREIGN PATENT DOCUMENTS 55-37521 3/1980 Japan ..... 418/57

*Primary Examiner*—John J. Vrablik

*Attorney, Agent, or Firm*—Ostrolenk, Faber, Gerb & Soffen

[57] ABSTRACT

A scroll-type compressor comprising a stationary scroll member having a spiral-shaped wrap, an orbiting scroll member interleaved with said stationary scroll and having a spiral-shaped wrap of the same shape as that of the wrap of the stationary scroll member but performing an orbital motion without rotation, a compression chamber defined between the wraps of the scroll members, a crankshaft eccentrically connected to the orbiting scroll member for causing the orbiting scroll member to orbit, and a sealing apparatus for restraining radial leakage of compressed fluid. The sealing apparatus comprises elastic thrust bearing members for elastically supporting the stationary scroll in order to allow the stationary scroll to wobble upwardly and downwardly as the orbiting scroll performs the orbital motion simultaneously with wobbling upwardly and downwardly due to a pressure difference between the outside and the inside of the compression chamber. The invention provides advantage in that the upward and downward wobbling of the stationary scroll efficiently results in closely contacting ends of the warps with bottom surfaces of the surfaces of the scrolls, thereby restraining formation of radial clearances between the scrolls.

8 Claims, 4 Drawing Sheets

SCROLL-TYPE COMPRESSOR WITH AN APPARATUS FOR RESTRAINING COMPRESSED FLUID FROM BEING LEAKED

BACKGROUND OF THE INVENTION

1. Field of the Invention

The present invention relates to a scroll-type compressor, and more particularly to a sealing apparatus for restraining a compressed fluid in compression chambers of such a compressor from being leaked in which a stationary scroll is elastically supported at upper and lower portions thereof by means of elastic supporting members, thereby being easily applied to the scroll-type compressors regardless of sizes of the compressors.

2. Description of the Prior Art

With reference to FIG. 1, which shows a conventional scroll-type compressor for compressing, expanding or pumping fluids, for example, a refrigerant gas, the scroll-type compressor is provided with a hermetic shell 1, a compressing part 2 and a driving motor part 3, each being enclosed in the shell 1. In addition, a fluid passage for guiding the low pressure fluid, which is subjected to be compressed, to compression chambers 12 is provided to the compressor. The fluid passage includes a suction pipe 4 penetrating a side wall of the shell 1 and communicating with an external device, for example, an evaporator (not shown) of a refrigerator. On the other hand, there is a discharge pipe 11 provided at an upper end of compressor in order to guide the compressed fluid of high pressure from the compression chambers 12 to another external device, for example, a condenser (not shown) of the refrigerator.

The compressing part 1 of the compressor generally comprises a stationary scroll 5, an orbiting scroll 6 interleaved with the stationary scroll 5, a crankshaft 7 driving the orbiting scroll 6 in order to cause the scroll 6 to orbit and a main frame 8 for supporting the crankshaft 7 and the orbiting scroll 6. The stationary scroll 5 is intergrally provided with a wrap 5*a* having a convolution in the form of an involute or a combination of involutes and arcs, while the orbiting scroll 6 is intergrally provided with a wrap 6*a* having the same shape as that of the wrap 5*a* of the stationary scroll 5 but with the opposite direction of convolution. The wraps 5*a* and 6*a* of the scrolls 5 and 6 are interleaved with each other in order to define the compression chambers 12 therebetween.

Additionally, an Oldham coupling 9 is disposed between the orbiting scroll 6 and the main frame 8, thereby supporting the orbiting scroll 6 to be restrained from freely rotating. The crankshaft 7 has at the upper end thereof an eccentric shaft pin 7*a* which is connected to a downwardly extending hollow shaft of the orbiting scroll 6 by means of an eccentric busing 10 interposed therebetween. Thus, upon being driven by the crankshaft 7, the orbiting scroll 6 performs orbital motion about a point without rotation, thereby progressively decreasing the volumes of the compression chambers 12 between the wraps 5*a* and 6*a*, thus compressing the fluid in the chambers 12. Upon being compressed, the compressed fluid in the chambers 12 is discharged from the compressor through the discharge pipe 11.

At this time, the orbiting scroll 6 may wobble upwards and downwards due to a pressure difference between the inside and the outside of the compression chambers 12 so that minute radial clearances C and C' (see FIG. 2) may be formed between the scrolls 5 and 6, that is, between the ends of the wraps 5*a* and 6*a* and the bottom surfaces of the opposite scrolls 5 and 6. Therefore, there may occur a radial leakage of the compressed fluid in the compression chambers 12 through the radial clearances C and C'. Thus, the known scroll-type compressor generally provided with sealing members for restraining the radial leakage of the compressed fluid through the radial clearance will be described hereinafter.

As shown in FIG. 2 which is an enlarged sectional view showing the part "A" of FIG. 1, a fitting slit 5*b*, 6*b* of a predetermined depth is formed at the end of each wrap 5*a*, 6*a* in order to vertically receive elastic tip sealings 13, 13', thereby accomplishing the sealing members having a relatively simple structure. In orbital motion of the orbiting scroll 6, the tip sealings 13, 13' elastically expands and contracts depending upon the downward and upward wobbling of the orbiting scroll 6 in order to compensate for the radial clearances C and C' between the scrolls 5 and 6, thereby restraining the radial leakage of the clearances C and C'.

However, the above sealing members generally need to be made of a material having a good consume resistance, a good lubrication. Thus, the known sealing members for the scroll-type compressor have a disadvantage in that there is a considerable difficulty in selecting the materials of the sealing members. In addition, the fitting slits 5*b* and 6*b* are generally machined by an end mill machining, respectively, and the wraps 5*a* and 6*a* each is generally formed as having a relative narrow width so that the known sealing members have another disadvantage in that the fitting slits 5*b* and 6*b* need to be elaborately machined. Furthermore, the known sealing members have another disadvantage in that it may be impossible to machine the fitting slits 5*b* and 6*b* due to narrow wraps 5*a* and 6*a* in case of small size compressor.

SUMMARY OF THE INVENTION

It is, therefore, an object of this invention to provide a sealing apparatus for sealing a radial leakage of compressed fluid in a compression chambers of a scroll-type compressor in which the above-mentioned problems can be overcome, and a stationary scroll is supported by means of elastic supporting members, thereby easily applying the apparatus for the compressors regardless of the size of the compressors and causing the selection for the materials of the sealing members to be considerably facilitated.

Thus, the present invention provides a scroll-type compressor comprising: a stationary scroll member having a spiral-shaped wrap; an orbiting scroll member interleaved with said stationary scroll and having a spiral-shaped wrap of the same shape as that of said wrap of the stationary scroll member but performing an orbital motion without rotation; a compression chamber defined between the wraps of the scroll members; a crankshaft eccentrically connected to the orbiting scroll member for causing the orbiting scroll member to orbit; and elastic bearing means for elastically supporting the stationary scroll in order to allow said stationary scroll to wobble upwardly and downwardly as the orbiting scroll performs the orbital motion simultaneously with wobbling upwardly and downwardly due to a pressure difference between the outside and the inside of the compression chamber, whereby the upward and downward wobbling of the stationary scroll efficiently resulting in closely contacting ends of said warps with bottom surfaces of said scrolls, thereby restraining formation of radial clearances between the scrolls.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

The scroll-type compressors, which will be described hereinafter and is provided with embodiments of a sealing apparatus according to this invention, include the similar elements to those of the above-mentioned known scroll-type compressors except for the sealing apparatus for restraining the radial leakage of a compressed fluid. Thus, in the following description, the same numbers as those of the description of prior art will denote the similar elements to those of the above-mentioned known scroll-type compressor.

As shown in FIGS. 3 to 6 each of which shows an embodiment of a sealing apparatus for a scroll-type compressor according to this invention, the sealing apparatus comprises two parts, that is, a plurality of upper elastic supporting members for downwardly and elastically supporting a stationary scroll 5 and a plurality of lower elastic supporting members for upwardly and elastically supporting the stationary scroll 5. Thus, during an orbital motion of the orbiting scroll 6, the stationary scroll 5 wobbles upwardly and downwardly by virtue of the elasticity of the upper and lower elastic supporting members, while an orbiting scroll 6 orbits simultaneously with wobbling upwardly and downwardly, thereby efficiently compensate a clearance which may be formed between the scrolls 5 and 6.

Figure 1:
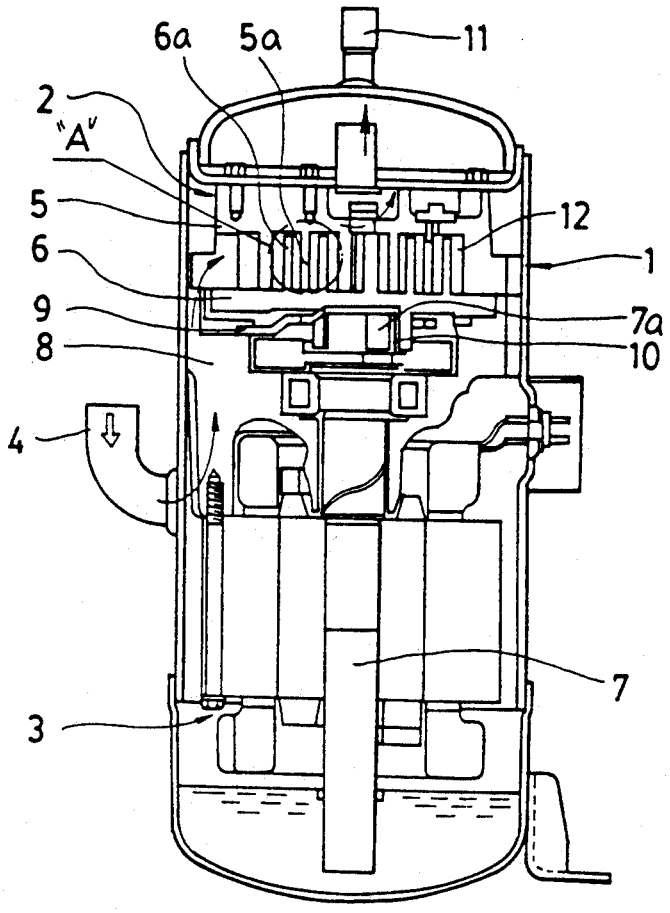
FIG.1 PRIOR ART
FIG. 1 is a sectional view showing an inner construction of a known scroll-type compressor.
Figure 2:
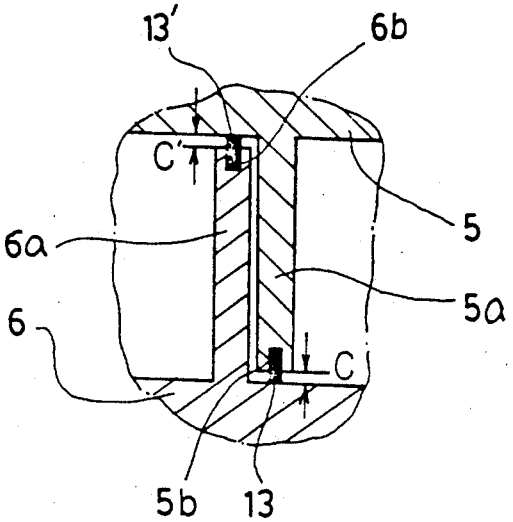
FIG.2 PRIOR ART
FIG. 2 is an enlarged sectional view of the part "A" of FIG. 1 for showing a construction of known sealing members.
Figure 3:
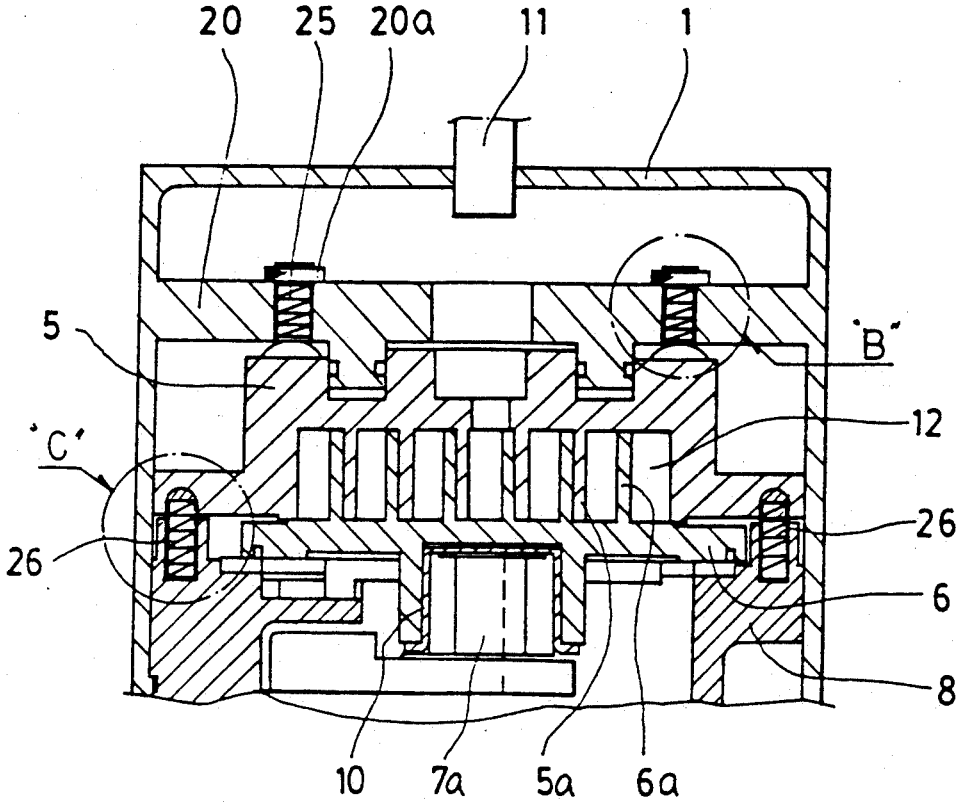
FIG. 3 is a partial-sectional view of a scroll-type compressor provided with an embodiment of a sealing apparatus in accordance with this invention.
Figure 4:
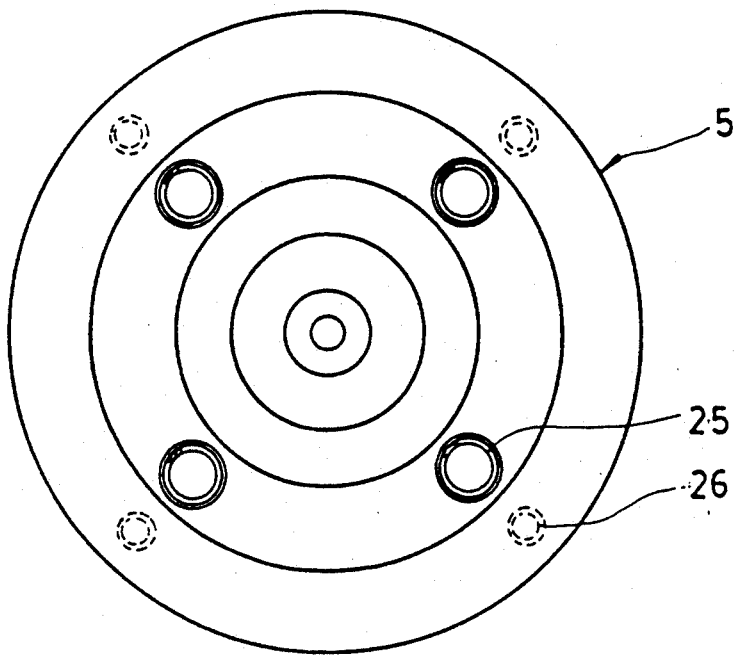
FIG. 4 is a schematic plane view showing the locations of the elastic supporting member of FIG. 3.
Figure 5:
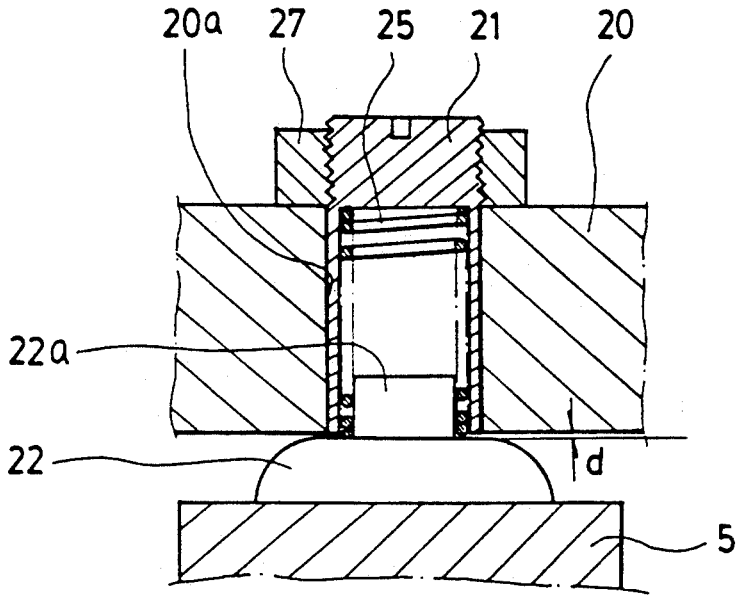
FIG. 5 is an enlarged sectional view of the part "B" of FIG. 3.

Turning next to FIG. 5 which shows an upper elastic supporting member of the part "B" of FIG. 3, the supporting member includes a plurality of fixed cylinders 21 which are received by a plurality of insert holes 20*a*, being formed on an upper partition 20 of a hermetic shell 1 as having a predetermined space therebetween. The fixed cylinder 21 receives therein an elastic member, such as a compression coil spring 25 for supporting the stationary scroll 5 downwardly. Additionally, a biasing member 22 is elastically disposed between the compression coil spring 25 and an upper surface of the stationary scroll 5 by inserting an upwardly extending insert 22*a* thereof into the lower inner portion of the spring 25. Thus, the biasing member 22 closely contacts with and biases downwardly the stationary scroll 5, and also is restrained from displacement in the radial direction.

On the other hand, the partition 20 is provided with a plurality of inner thereaded bosses 27 with each of which an outer threaded top portion of the fixed cylinder 21 engages by virtue of a screwed pipe fitting, thereby accomplishing the insertion of the cylinder 21 into the insert hole 20*a*. Also, the biasing member 22 is disposed in order to secure a minute clearance "d" between the upper end thereof and a lower surface of the partition 20 as shown in FIG. 5. The clearance "d" is provided in order to compensate a sudden upward wobbling, exceeding a predetermined range, of the stationary scroll 45 due to a sudden pressure rising of the compressed fluid in the compression chambers 12.

Figure 6:
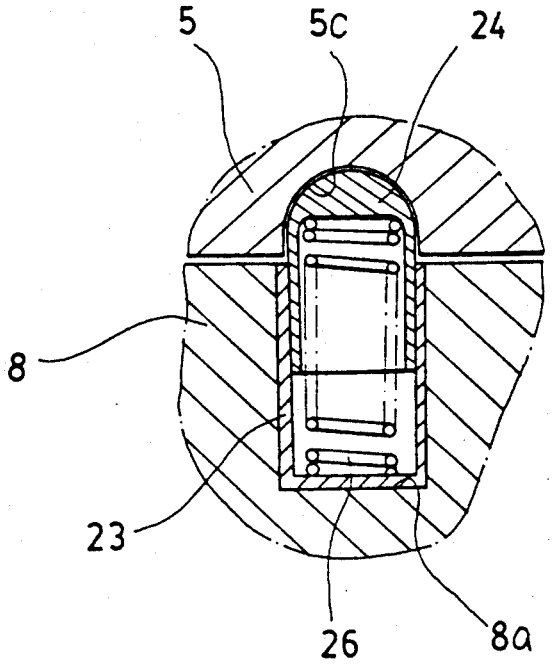
FIG. 6 is an enlarged sectional view of the part "C" of the FIG. 3.

Turning to FIG. 6 which shows a lower thrust bearing member of the part "C" of FIG. 3, the supporting member includes a plurality of lower fixed cylinders 23 which are received by a plurality of receiving holes 8*a* which are formed at an upper surface of a main frame 8 as having a predetermined space therebetween. The fixed cylinder 23 receives therein an elastic member, such as a compression coil spring 26 for supporting the stationary scroll 5 upwardly. In addition, the stationary scroll 5 has at the under surface thereof a plurality of hemispherical grooves 5*c* in a predetermined space therebetween in order to receive a plurality of upper fixed cylinders 24. The upper fixed cylinder 24 comprises a hemispherical head, which is received by the groove 5*c*, and a cylindrical body which is upward and downward movably inserted into the lower fixed cylinder 23. Accordingly, the lower elastic supporting members support upwardly the stationary scroll 5 by virtue of cooperation of the spring 26 and the upper fixed cylinder 24, thereby allowing the scroll 5 to wobble and also compensating a radial clearance which may be formed between the scrolls 5 and 6.

In the drawings, the upper and lower elastic supporting members each comprises four members each disposed at every 90° angle. However, the elastic supporting members may comprise more or less members than those shown in the drawings, as requested.

Additionally, the elastic member of each supporting member may comprise an elastic rubber having a good heat resistance besides the compression coil springs 26, 25 shown in the drawings.

It is desired to select the elasticity of the upper elastic supporting members in order to be different from that of the lower thrust bearing members. That is, the elasticity of the upper supporting members is selected to be higher than that of the lower bearing members so that the end of the stationary wrap 5*a* can be closely in contact with the bottom surfaces of the orbiting scroll 6 so as to efficiently restrain the radial leakage of the compressed fluid out of the compression chambers 12.

The operational effect of the embodiment of the sealing apparatus of the above-mentioned construction will be described in the following description.

At a state of turning off the compressor, the upper compression coil spring 25 disposed in the fixed cylinder 21 of the upper elastic supporting member biases the biasing member 22 downwardly, while the lower compression coil spring 26 disposed between the lower and upper fixed cylinders 23 and 24 biases the upper fixed cylinder 24 upwardly. Thus, the ends of each wrap 5*a*, 6*a* of the scroll 5, 6 closely contact with the bottom surfaces of the opposite scroll 6, 5, thereby efficiently restraining formation of a radial clearance from being formed there between. At this time, the predetermined clearance "d" is continuously secured between the upper end of the biasing member 22 and the lower surface of the partition 20.

Thereafter, upon turning on the compressor, the driving motor part 3 drives the crankshaft 7 so that the shaft pin 7*a* of the crankshaft 7 causes the orbiting scroll 6 to perform the orbital motion about a point without rotation, thereby progressively decreasing the volumes of the compression chambers 12 defined between the wraps 5*a* and 6*a*, and compressing the fluid in the chambers 12. Upon being compressed, the compressed fluid in the compression chambers 12 is discharged out of the compressor through the discharge pipe 11.

At this time, the orbiting scroll 6 wobbles upwardly and downwardly due to the pressure difference between the inside and the outside of the compression chambers 12. In result, the stationary scroll 5, which is interleaved with the orbiting scroll 6 by means of the wraps 5*a* and 6*a* of the scrolls 5 and 6, also wobbles upwardly and downwardly in a predetermined wobbling range provided by the clearance "d" by virtue of the difference between the elasticity of the upper compression coil springs 25 and the elasticity of the lower compression coil springs 26. Thus, it is efficiently restrained to form a radial clearance between the stationary and orbiting scrolls 5 and 6, thereby preventing the radial leakage of the compressed fluid out of the compression chambers 12.

In other words, upon being elastically biased by the upper and lower compression coil springs 25 and 26 downwardly and upwardly, respectively, the wraps 5*a* and 6*a* of the stationary and orbiting scrolls 5 and 6 always closely contact with the bottom surfaces of the orbiting and stationary scrolls 6 and 5. At this state, upon orbital motion of the orbiting scroll 6 by virtue of the rotation of the crankshaft 7 simultaneously with upward and downward wobbling due to the pressure difference between the inside and the outside of the compression chambers 12, the stationary scroll 5 upwardly and downwardly wobbles at the same time by virtue of the elasticity difference between the upper and lower compression coil springs 25 and 26. Thus, the uppermost ends of the wraps 5*a* and 6*a* always closely contact with the bottom surfaces of the scrolls 6 and 5 in spite of the wobbling movement of the orbiting scroll 6 due to the pressure difference of the outside and the inside of the compression chambers 12, thereby securing the radial sealing for restraining the radial leakage of the compressed fluid out of the compression chambers 12.

In addition, the clearance "d" formed between the upper surface of the biasing member 22 and the lower surface of the partition 20 can be efficiently adjusted by screwed-type turning of the fixed cylinder 21 in opposite directions so as to upwardly and downwardly displace the fixed cylinder 21. It is desired to adjust the clearance "d" in order to suitably compensate a sudden upward wobbling, exceeding a predetermined range, of the stationary scroll 5 due to a sudden pressure rising of the compressed fluid in the compression chambers 12.

In the above description, the upper and lower elastic supporting members each comprises cylinders and a compression coil spring. However, as the upper and lower elastic supporting members, leaf springs may be used as follows.

Figure 7:
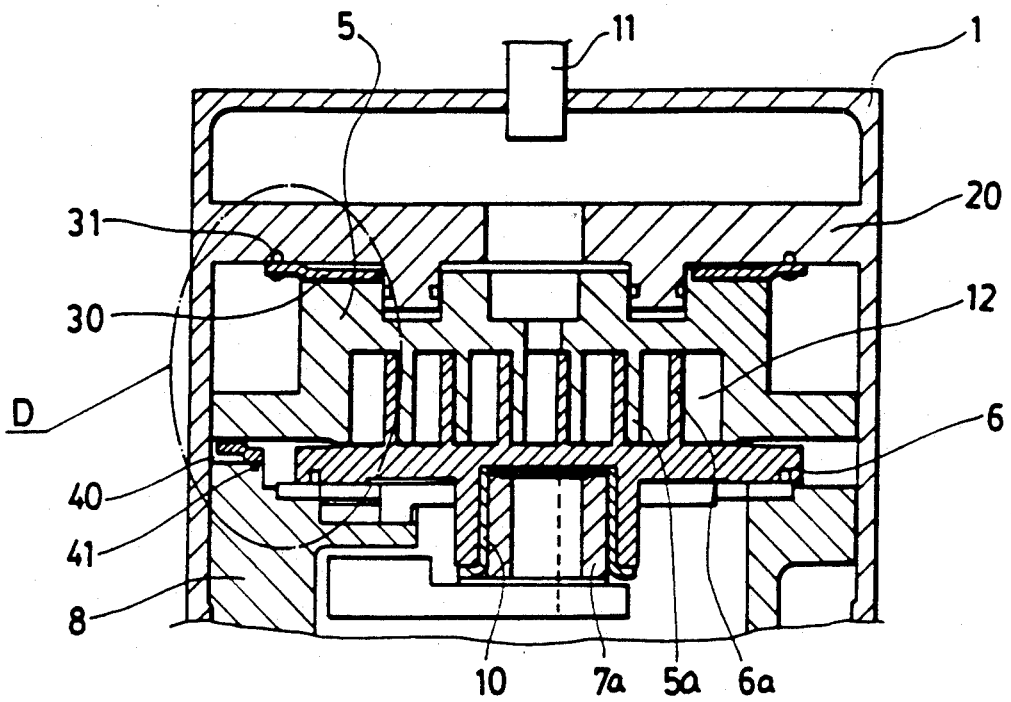
FIG. 7 is a view corresponding to FIG. 3, but showing a scroll-type compressor provided with another embodiment of a sealing apparatus in accordance with this invention.
Figure 8:
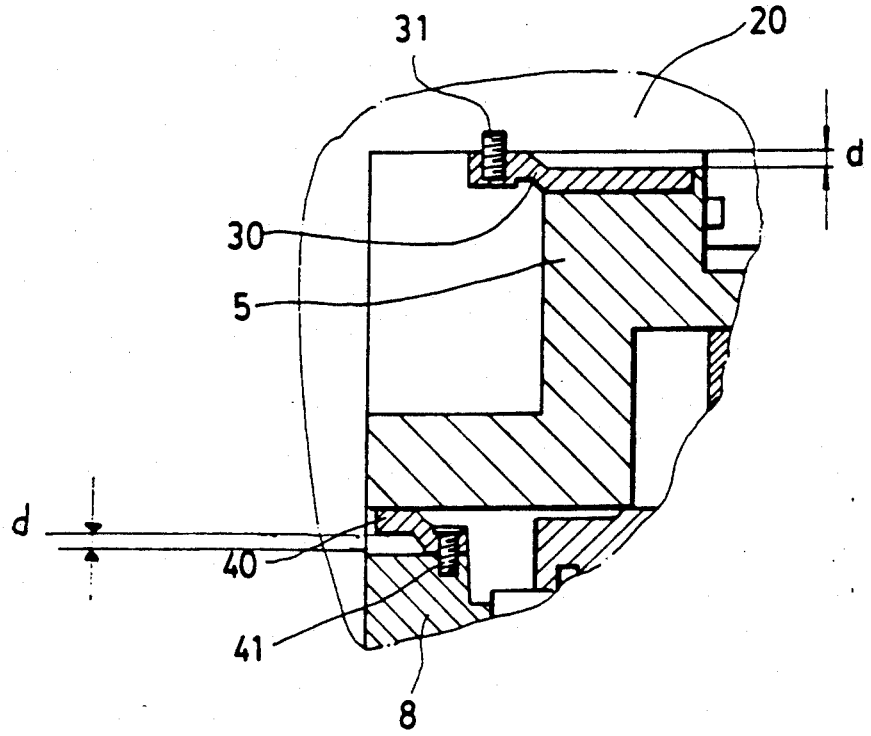
FIG. 8 is an enlarged sectional view of the part "D" of FIG. 7.

In FIGS. 7 and 8 which show another embodiment of a sealing apparatus for a scroll-type compressor according to this invention, the same elements as those of the above-mentioned first embodiment of the sealing apparatus will have the same numbers as those of the first embodiment.

As shown in FIGS. 7 and 8, the upper elastic supporting members each comprises a leaf spring 30 of which one end portion is mounted to a lower surface of the partition 20 by means of a fixture 31, while a lower surface of the other end portion thereof elastically and closely contacts with an upper surface of the stationary scroll 5. Thus, there is provided a clearance "d" between a lower surface of the partition 20 and the upper surface of the stationary scroll 5. On the other hand, the lower elastic supporting members each comprises a leaf spring 40, which has a relatively smaller spring constant than that of the leaf spring 30 of the upper supporting members, and of which one end portion is mounted to an upper surface of the main frame 8 by means of a fixture 41, while an upper surface of the other end portion thereof elastically and closely contacts with a lower surface of the stationary scroll 5. Thus, there is provided a clearance "d" between an upper surface of the frame 8 and a lower surface of the other end portion of the leaf spring 40, thereby making it possible to bias the scroll 5 upwardly.

In addition, the upper and lower elastic supporting members, that is, the upper and lower leaf springs 30 and 40 are arranged on the partition 20 and the main frame 8, respectively, so as to be disposed on concentric circles in a predetermined space therebetween. As described in the description for the first embodiment, the leaf springs as the supporting members may optionally comprise more than three leaf springs.

Also, it is desired to select a spring constant of the upper plate spring 30 so as to be different from that of the lower plate spring 40. That is, the spring constant of the upper spring 30 is selected to be higher than that of the lower spring 40 so that the lowermost ends of the stationary wrap 5*a* can be closely contacted with the bottom surfaces of the orbiting scroll 6 so as to efficiently restrain the formation of radial clearances C and C' between the scrolls 5 and 6. The clearance "d" which is provided between the lower surface of the partition 20 and the upper surface of the plate spring 30 as shown in FIG. 8 can compensate a sudden upward wobbling, exceeding a predetermined range, of the stationary scroll 5 due to a sudden pressure rising of the compressed fluid in the compression chambers 12.

In the drawings, the upper and lower elastic supporting members comprise a plurality of leaf springs 30 and 40 which are separately provided. However, the upper and lower bearing members each may comprise another type of spring, for example, an integral annular spring having a plurality of radial slits each formed as being radially and inwardly slit from the outer periphery thereof.

In addition, it is desired to form a plurality of slots each having a depth and a width of the same sizes as those of the thickness and the width of the springs 30, 40 in order to sink the springs 30 and 40 into the slots.

The above-mentioned another embodiment of the sealing apparatus of this invention has the similar operational effect to that of the first embodiment of the sealing apparatus. Thus, the operational effect of the elastic supporting members comprising the leaf springs 30 and 40 will be referred to the description for the operational effect of the elastic supporting members comprising the cylinders and the compression coil springs 25 and 26.

As described above, the present invention provides a sealing apparatus for a scroll type compressor in which a stationary scroll is elastically supported downwardly and upwardly at upper and lower surfaces thereof by means of a plurality of upper and lower elastic supporting members, respectively. Thus, the stationary scroll can wobble upwardly and downwardly by means of the supporting members as an orbiting scroll of the compressor performs an orbital motion by virtue of a driving power of a crankshaft simultaneously with wobbling upwardly and downwardly due to a pressure difference between the inside and the outside of a compression chambers defined between the stationary and orbiting scrolls, thereby efficiently restraining the formation of radial clearances between the stationary and orbiting scrolls.

In result, the sealing apparatus of this invention can provide advantage in that it efficiently restrains a radial leakage of compressed fluid out of the compression chambers through the radial clearances. Furthermore, the apparatus provides another advantage in that it provides facility in selecting the materials for the sealing members and machining the sealing members, and also being applied to scroll-type compressors regardless of sizes of the compressors.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. An apparatus for restraining leakage of compressed fluid in a scroll-type compressor having a main frame and a partition, said apparatus comprising:

upper stationary scroll having a first spiral-shaped wrap;

lower orbiting scroll interleaved with said upper stationary scroll, said lower orbiting scroll having a second spiral-shaped wrap being of the same shape as said first spiral-shaped wrap;

means for orbiting said lower orbiting scroll without rotation;

elastic supporting means for elastically supporting said upper stationary scroll in order to allow said upper stationary scroll to wobble upwardly and downwardly as said lower orbiting scroll performs the orbital motion simultaneously with wobbling upwardly and downwardly, said elastic supporting means comprising: upper elastic supporting means mounted on said partition over said upper stationary scroll, said means being adapted for elastically supporting said upper stationary scroll downwardly; and lower elastic supporting means mounted on said main frame supporting said lower orbiting scroll, said means being adapted for elastically supporting said upper stationary scroll upwardly.

2. The apparatus as claimed in claim 1, wherein each said upper elastic supporting means comprises:

a cylinder received in an insert hole formed in said partition;

elastic support means received in said cylinder in order to bias the stationary scroll downwardly; and biasing means detachably connected to said elastic support means so as to be disposed between the elastic support means and the stationary scroll and also closely contact with an upper surface of the stationary scroll.

3. The apparatus as claimed in claim 2, wherein said cylinder is capable of being displaced upwardly and downwardly in order to control a clearance formed between a lower surface of the partition and said biasing means.

4. The apparatus as claimed in claim 2, wherein each said lower elastic supporting means comprises:

a lower cylinder received in a receiving hole formed in said main frame;

an upper cylinder supported at an upper end thereof by a groove formed on a lower surface of the stationary scroll, and also received at a lower body thereof in said lower cylinder; and elastic support means received in said lower cylinder so as to be disposed between said upper and lower cylinders, thereby biasing the stationary scroll upwardly.

5. The apparatus as claimed in claim 1, where each said upper elastic supporting means has a relatively higher elastic modulus than that of each said lower elastic supporting means.

6. The apparatus as claimed in claim 1, wherein each said upper elastic supporting means comprises:

elastic means mounted at one end portion thereof to a lower surface of the partition by means of a mounting member, and at the other end portion thereof elastically and closely contacting with an upper surface of the stationary scroll, thereby biasing the stationary scroll downwardly.

7. The apparatus as claimed in claim 1, wherein each said lower elastic supporting means comprises:

elastic means mounted at one end portion thereof to an upper surface of the main frame by means of a mounting member, and at the other end portion thereof elastically and closely contacting with a lower surface of the stationary scroll, thereby biasing the stationary scroll upwardly.

8. The apparatus as claimed in claim 6, wherein said elastic means is disposed in order to provide a predetermined clearance between the lower surface of the partition and an upper surface of the other end portion thereof.

* * * * *